United States Patent [19]

Nichols, Jr.

[11] Patent Number: 4,761,201

[45] Date of Patent: Aug. 2, 1988

[54] SELF CONTAINED APPARATUS TO GUIDE A ROLL OF ROOFING MATERIAL, TO HEAT THE DEPARTING ROOFING MATERIAL, AND TO ACCURATELY AND SEALABLY LAY THE HEATED ROOFING MATERIAL ON A ROOF SURFACE

[76] Inventor: Steven C. Nichols, Jr., 21808 N.E. 175th, Woodinville, Wash. 98072

[21] Appl. No.: 869,381

[22] Filed: May 29, 1986

[51] Int. Cl.[4] ..... B32B 35/00; B44C 7/06

[52] U.S. Cl. ..... 156/497; 156/499; 156/577; 156/579

[58] Field of Search ..... 156/497, 499, 577, 579, 156/82, 574

[56] References Cited

U.S. PATENT DOCUMENTS

| | | | |
|---|---|---|---|
| 1,278,272 | 9/1918 | Wilson | 156/577 |
| 2,084,625 | 6/1937 | Stebbins et al. . | |
| 3,097,986 | 7/1963 | Kauer | 156/577 |
| 3,962,016 | 6/1976 | Alfter et al. | 156/497 |
| 4,087,309 | 5/1978 | Lang | 156/579 |
| 4,204,904 | 5/1980 | Tabor | 156/497 |
| 4,239,581 | 12/1980 | Lang | 156/579 |
| 4,242,173 | 12/1980 | Stenemann | 156/577 |
| 4,259,142 | 3/1981 | Kortepeter | 156/497 |
| 4,313,780 | 2/1982 | Ford, Jr. | 156/579 |
| 4,354,893 | 10/1982 | Kugler et al. | 156/497 |

*Primary Examiner*—Michael Wityshyn

*Attorney, Agent, or Firm*—Roy E. Mattern, Jr.

[57] ABSTRACT

A self contained apparatus is utilized for direct movement on and across a roof surface to lay on the roof surface a continuous sheet or roofing material being removed from a roll guided at each of its ends by this apparatus, and being heated, before being removed, by a heating assembly pivotally supported by the apparatus and pivotally adjusted, so the distance between the roll and the heating assembly is maintained. An inclined A frame of the apparatus has a handle at its apex, and bottom opening slots at its lower ends to fit over the ends of a shaft on which the roll of roofing material is positioned. There is a depending wheel assembly below the handle serving to complete the triangular support of this self contained apparatus. The inclined A frame is pivoted about the wheel assembly to clear the bottom opening slots from the shaft ends and vice versa, when a roll of roofing material is being supplied, withdrawn, and/or adjusted to a different set of slots. Accessories, if required, are added such as a heat shield located on the inclined A frame between a gas tank and the burners or heaters. Also retractable locks are used to keep the shaft ends in place at the slots at the bottom of the inclined A frame. During the use of this self contained apparatus, the cantilevered weight thereof essentially directly supplements the weight of the roll of roofing material to very effectively sealably press the heated sheet of roofing material accurately in place on the roof surface.

8 Claims, 2 Drawing Sheets

FIG. 1
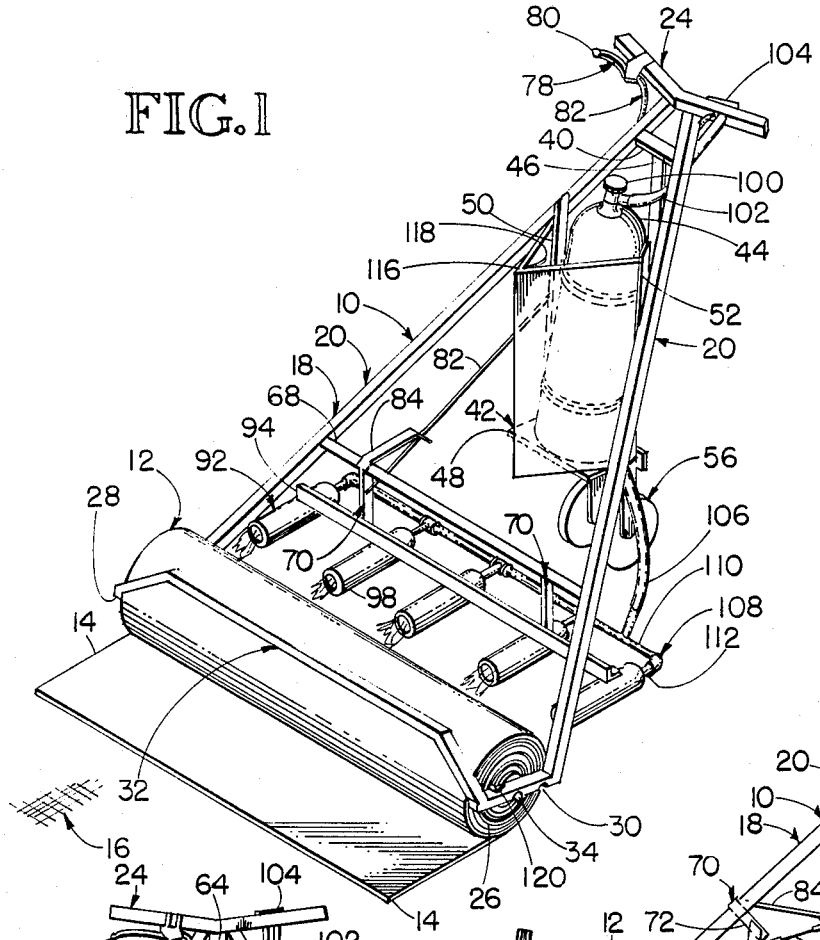
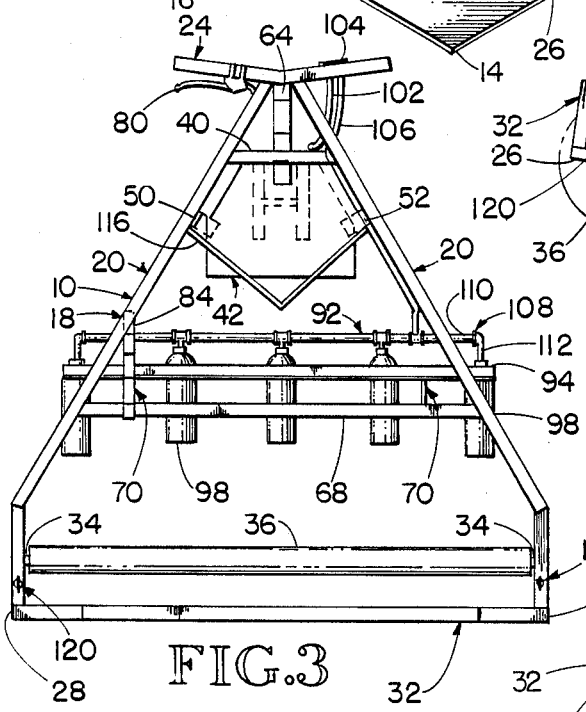
FIG. 3
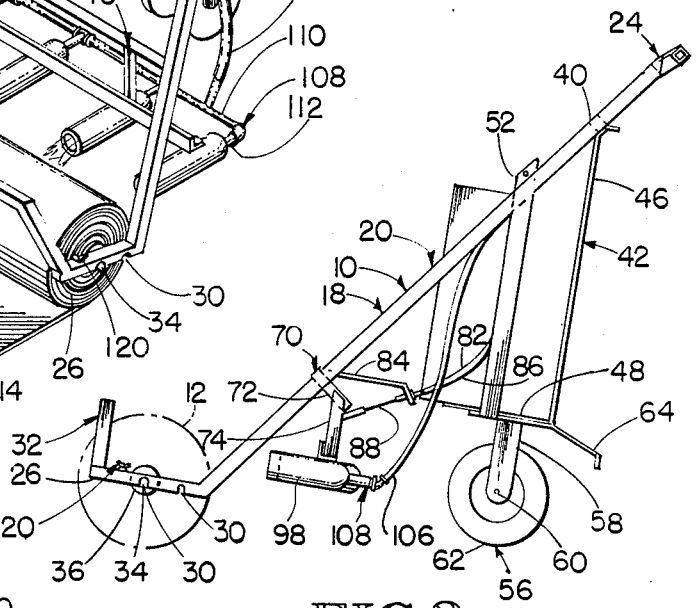
FIG. 2
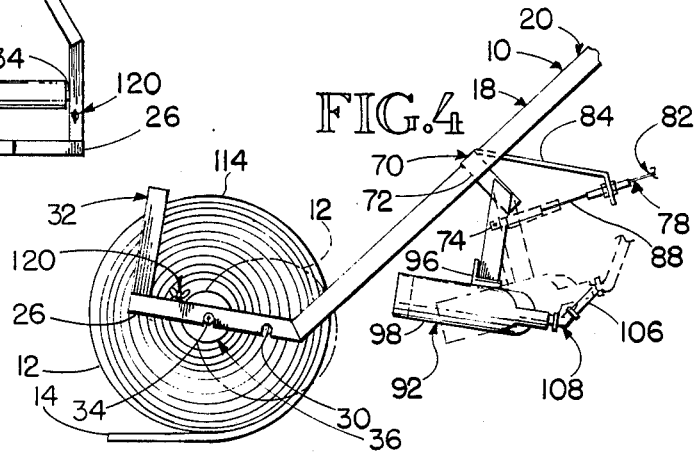
FIG. 4

FIG.5
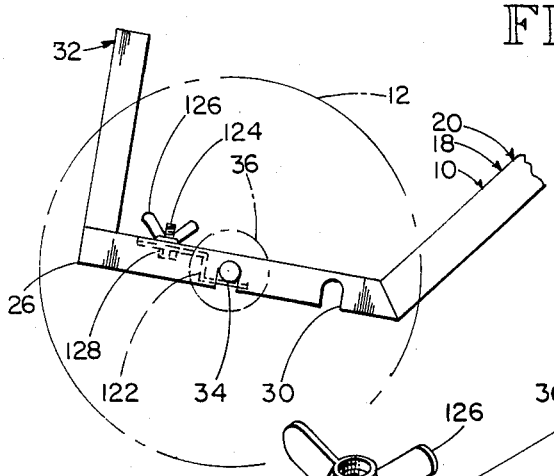
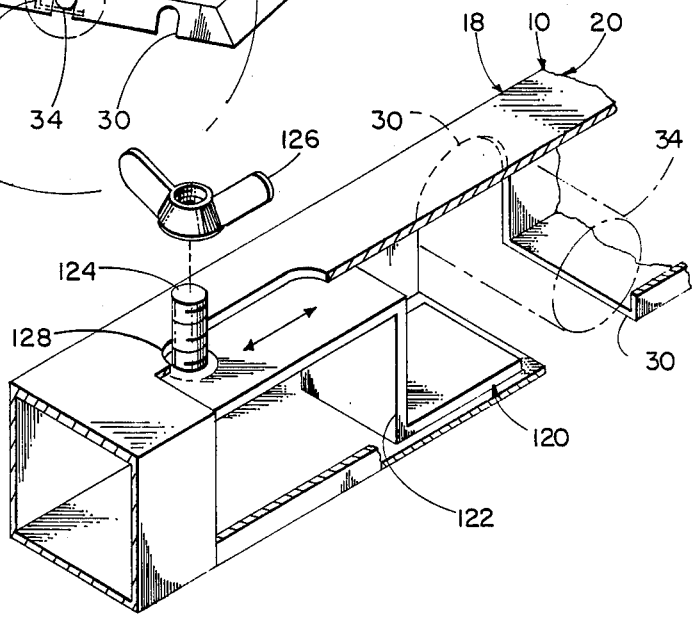
FIG.6

SELF CONTAINED APPARATUS TO GUIDE A ROLL OF ROOFING MATERIAL, TO HEAT THE DEPARTING ROOFING MATERIAL, AND TO ACCURATELY AND SEALABLY LAY THE HEATED ROOFING MATERIAL ON A ROOF SURFACE

BACKGROUND

Waterproof roofing materials derived from rolls and laid across a roof structure, with their edges overlapped and sealed, have been used for several years. More recently some of these roofing materials are made with an entire adhesive undercoating layer, and during their placement on a roof structure, the adhesive undercoating is preheated throughout the width of the roll of roofing material.

In 1963, Walter Kauer in his U.S. Pat. No. 3,097,986 described and illustrated his sheet applying apparatus used in applying a sheet of roofing paper, derived from a roll, to a roof surface. His apparatus was self contained, carrying both the roll of roofing paper and a heating unit. His apparatus automatically applied a uniform heat both to the roofing paper and to the roof before the roofing paper was reliably pressed against the roof surface by utilizing his apparatus. The heating unit position was adjusted as the roofing roll decreased in diameter, so the distance between the heat discharge and the exterior of the roofing roll remained substantially unchanged. A carriage releasibly supported the roll of roofing paper and positioned the heating fluid tank of the heating unit directly over the roll of roofing paper. Transversely spaced wheels advanced ahead of the roofing roll and transversely arranged pressing rolls followed behind the roofing roll.

In 1982, William E. Kugler and James M. Pacello in their U.S. Pat. No. 4,354,893 illustrated and described their combination roofing material unrolling and heat applying apparatus, directed to the like purpose to be served by using Walter Kauer's sheet applying apparatus. They provided a way to move the heat discharge toward and away from a roofing roll and not be required to keep the heat discharge, via pivotable spaced burners, in a parallel relationship to the roofing roll. Their carriage releasibly supported the roll of roofing paper, which in turn provided the following rolling support of the carriage. The leading support was provided by two spaced wheels. As so illustrated their carriage did not support a tank containing a heating fluid.

Before 1963 and through 1982, other persons in U.S. patents have illustrated and disclosed their apparatus designed to seal the overlapping edges of roofing sheets already laid in place, such as:

Messrs. Stebbins and Yeager's apparatus for laying sheet material set forth in their U.S. Pat. No. 2,084,625, wherein they heated the overlapping edges;

John N. Lang's apparatus for sealing lap joints of fusible roofing sheets as disclosed in his U.S. Pat. No. 4,087,309, wherein the fuel source was carried on his carriage;

Donald R. Tabor's roofing material handling and sealing machine as shown and described in his U.S. Pat. No. 4,204,904, wherein the leading two wheels straddled the overlapping edge portions of the roofing material and the rear single wheel pressed against these overlapping edge portions;

John N. Lang's apparatus for sealing lap joints of fusible roofing sheets, as disclosed in another one of his U.S. Pat. Nos., 4,239,581, which also carried a fuel source and two flame chambers; and Dale T. Kortepeter's machine for applying roofing material, as disclosed in U.S. Pat. No. 4,259,142, separated and heated overlying edges of prelaid roofing material sheets to soften their facing layers of bitumen material, and thereafter pressed these overlying heated edges together upon the passage of a trailing pressing roller.

Although these prior patentees provided useful apparatus to be used in applying sheet roofing material, derived from rolls, which required heating at least at the edges, and/or across their roll widths, there remained a need for apparatus which could be reliably used more conveniently to effectively and accurately lay roofing material as it was unrolled and as it was heated and sealed along the overlapping edges and across the width of each sheet.

SUMMARY

For accurately and efficiently unrolling, heating and sealably pressing in place a continuous sheet of roofing material, a self contained apparatus is used for direct movement across a roof surface of a dwelling. The apparatus, via its frame, is rotatably supported at three triangular locations. Two of these locations are determined by ends of a roll of roofing paper positioned about a removable shaft. The shaft is received in bottom opening slots of the frame, which are pivoted down over the ends of the shaft. The frame is A shaped and positioned on an incline terminating in an apex structure, which supports a handle. Depending from the inclined A shaped frame near the handle, is a centered wheel assembly positioning a wheel in the third triangular support location. The frame is pivotal about the wheel to raise the bottom opening slots of the frame above the ends of the shaft to remove a shaft and its depleted roll of roofing material, and to thereafter lower the bottom opening slots of the frame to engage the ends of a shaft on which a new roll of roofing material has been placed. Preferably multiple spaced sets of these bottom opening slots of the frame are provided to selectively position the roll of roofing material with respect to the frame.

Depending from the A shaped frame are a pivotal assembly of spaced heating units sometimes selected and described as burning torches. Also depending from the A shaped frame is a supporting subframe to position a heating fluid tank and an optional heat shield. Then interconnected between the tank, a control valve located at the handle, and the spaced heating units, is a heating fluid distribution system.

Also interconnected between a hand lever located at the handle and the pivotal assembly of spaced heating units is a control cable, whereby the assembly of the spaced heating units is moved so the distance between the spaced heating units and the depleting roll of roofing paper remains the same, as the roof surface is being covered. Where multiple sets of the bottom opening slots of the frame are provided, the repositioning of the shaft supporting the roll is also used in conjunction with the pivoting of the assembly of the spaced heating units, so the distance between the spaced heating units and the roll of depleting roofing paper remains the same. Locks are slidably used to keep the shaft ends in respective pairs of bottom opening slots of the A frame, especially when a sloping roof is being recovered so a heavy roll will not be unwantedly released and fall off the roof. When this self contained apparatus is used, the cantilevered weight thereof importantly essentially directly supplements the weight of the roll of the roofing material to provide a sufficient pressing force to sealably position the heated sheet of roofing material accurately in place on the roof surface.

DRAWINGS

A preferred embodiment of the self contained apparatus used to carry, heat, and accurately and sealably lay roofing material on a roof surface is illustrated in the drawings, wherein:

FIG. 1 is a perspective view of the self contained apparatus as it is positioned on a roof surface and laying down a heated sheet of roof material derived from a roll, with the cantilevered weight of the apparatus supplementing the weight of the roll of roofing material to sealably press the heated sheet in place on the roof surface, showing a heating fluid tank in place with its optional heat shield;

FIG. 2 is a side view of the self contained apparatus not showing a heating fluid tank in place, and showing by phantom lines where the shaft positioning the roll of roofing material is guidably received;

FIG. 3 is a top view of the self contained apparatus not showing a heating fluid tank in place, and showing where the shaft which will receive a roll of roofing material, is guidably received; and FIG. 4 is a partial side view of the self contained apparatus showing two sets of spaced bottom opening slots used at alternate times to guidably receive the shaft ends in reference to the larger and smaller diameters of the roll of roofing material, and to show how the heating assembly is pivotally moved to keep the distance the same between the heating assembly and the roll of roofing material, during the heating of the roofing material, before it is sealably laid on a roof surface.

FIG. 5 is a partial side view of the self contained apparatus, to show how adjustable locks are used to keep the ends of a shaft in place, so a shaft and its roll of roofing material will remain securely attached to this self contained apparatus, until intentionally released; and FIG. 6 is a partial perspective view, with portions removed, to illustrate how the adjustable locks are translated between the unlocked and locked positions, with respect to releasing and/or to holding a roll of roofing paper in its position on the self contained apparatus.

DESCRIPTION OF THE PREFERRED EMBODIMENT

A preferred embodiment of the self contained apparatus 10 to guide a roll 12 of roofing material 14, to heat the departing roofing material 14, and to accurately and sealably lay the heated roof material 14 on a roof surface 16 is shown in FIG. 1. The triangular frame 18 of this apparatus 10 has an A frame portion 20 positioned on an incline, terminating above in an apex top 22 supporting a transverse horizontal handle 24, and terminating below on each side in respective receiving and guiding portions 26, 28 having bottom opening slots 30 arranged in pairs. These receiving and guiding portions are joined by a bumper cross brace 32.

The ends 34 of a shaft 36 on which a roll 12 of roofing material 24 is positioned, are guidably held captive, as the slots 30 are moved over and down upon the shaft ends 34. Extra shafts 36 are used with new rolls 12, so when a roll 12, being depleted, is about finished, a new roll 12 mounted on a shaft 36 is ready to be used.

The A frame portion 20 has a top cross brace 40 positioned below the handle 24 as shown in FIGS. 1 and 3. Secured both to this A frame and the top cross brace 40 is a depending sub frame 42, which supports a heating fluid tank 44, which is generally a propane gas tank 44 as shown in FIGS. 1 and 2. The sub frame 42 includes a centered depending vertical member 46 secured above to the top cross brace 40 and below to a tank support platform 48. Additional depending vertical members 50, 52 secured above to the A frame portion 20 and below to the tank support platform 48 complete this sub frame 42.

Depending below sub frame 42 and secured to it is a wheel assembly 56 having a sub frame 58, axle 60, and closely spaced wheels 62 as shown in FIGS. 1, 2 and 3. At this wheel location and secured to the depending sub frame 42 is a kicker bar 64, which is used when the triangular frame 18 is pivoted about axle 60, to raise the receiving and guiding portions 26, 28 and their bottom opening slots to clear them from ends 34 of the shaft 36, when a new roll 12 of roofing material 14 is to be guidably placed with respect to the receiving and guiding portions 26, 28, or a roll 12 is to be repositioned.

The A frame portion 20 has a bottom cross brace 68 positioned above the bumper cross brace 32, as shown in FIGS. 1 and 30 Depending from this bottom cross brace 68 are spaced hinge assemblies 70, each having an upper hinge portion 72 secured to the bottom cross brace 68 and a lower hinge portion 74 which is pivotal in a vertical plane, as shown in FIGS. 2 and 4. Pivotal movement of this lower hinge portion 74 is undertaken by using an actuator assembly 78 having a lever 80 secured to the handle 24, a push-pull shielded rod 82, secured between the lever 10 and the lower hinge portion 74, and a guiding support 84 secured to the bottom cross brace 68, to position the lower end of the shielded portion 86 of the push-pull shielded rod 82, nearby the lower hinge portion 74, as the push-pull rod 88 continues on to the lower hinge portion 74.

A heating assembly 92 is secured to the lower hinge portions 74 at its cross burner support frame 94, which in turn, via individual burner or torch brackets 96, positions at spaced locations burners or torches 98, to uniformly heat the exterior layer of the roll 12 of roofing material. The heating fluid, generally propane, is directed from a tank valve 100 of the heating fluid tank 44 through a hose 102 to a control valve 104 interfitted with the handle 24. When this control valve 104 is opened, the heating fluid passes through hose 106 down to a cross header assembly 108 of conduits 110, 112 directing the heating fluid to the respective burner or torches 98.

As shown throughout the drawings, but particularly in FIG. 4, the distance between the burners or torches 98 and the changing outer layer 114 of roofing material 14 about to leave the roll 12 is kept the same by using the actuator assembly 78 to pivotally move the heating assembly 92, via the hinge assemblies 70. Then after the roll 12 decreases sufficiently in size, it is moved nearer the heating assembly 92, after tilting the frame 18 about axle 60, to clear the shaft ends 34 and thereby the shaft 36 and roll 12 from one set of bottom opening slots 30 to an adjacent set of bottom opening slots 30 in the respective receiving and guiding portions 26, 28 of the A frame portion 20. With the roll 12 repositioned nearer the heating assembly 92, the actuator assembly 78 is readjusted and then utilized again to keep the distance the same, between the burners or torches 98 and the changing outer layer 114 of the roofing material 14. As this uniform heating is undertaken, the roofing material 14 is accurately guided, conveniently manipulated, efficiently heated and sealably laid down on a roof surface 16, by using this self contained apparatus 10.

In a specific embodiment to apply a single ply modified bitumen sheet of roof material, pieces of 1" by 1" square metal tube and 1½" metal strap were welded together as frame members. The burners or torches used propane in the range of pressure of 20–30 p.s.i. Constant flames were achieved by using pilot light control. The overall weight of the apparatus without a heating fluid tank was 70 pounds. The overall sizes were 43½ inches wide, 42½ inches long, and 41½ inches high.

This specific embodiment was sized to receive a 90 pound roll of roofing material A to lay down the membrane, i.e. the single ply modified bitumen sheet, for a 35 foot length 40 inches wide, before considering the sealing side laps of 3 inches to 4 inches wide. The triangular frame 18, utilizing the inclined A frame portion 20, creates a three point support consisting of the two roll ends, i.e. shaft ends 34, and the centered wheel assembly 56. The overall control location is located right at the handle 24 for keeping the unrolling membrane leaving the roll 22 well aligned.

This light weight, strong frame provides unobstructed visibility of the roll 12 of roofing material 14, as the unrolling and heating is undertaken. When roll 12 positions are undertaken and when roll 12 changes are made this self contained apparatus 10 is quickly and easily manipulated, via tilting and rolling, to clear the bottom opening slots 30 from the shaft ends 34 without disturbing the alignment of the already laid roofing material 14.

The uniformly heated roofing material 14, heated via the self contained heating assembly 92, which is constantly adjustable in position, is evenly laid down under the weight of the roll 12 and the cantilevered resultant weight of the frame 18. The overlapping sealed seams of the roofing material are accurately formed, positioned, heated and sealed.

As illustrated in FIGS. 1, 2, and 3, an optional heat shield 116 is removably bolted in place on the A frame 20, between the heating fluid tank 44 and the heating assembly 92. It is a metal shield 116, which is optionally lined with an insulating material 118. Preferably it has a V configuration to create the insulating space about the heating fluid tank 44.

Also, as illustrated in all figures, and especially in FIGS. 5 and 6, slidable locks 120 are used to close off the otherwise open bottom notches or slots 30, to keep the shaft ends 34 in place. Such retention is especially useful, when heavy rolls 12 of roofing material 14 are being handled on comparatively steep roofs. Such retention, avoids any loss of a roll which might otherwise get free and then roll off the roof. The offset lock body portion 122, is equipped with a welded threaded stud 124, which receives the nut 126. The respective slots 128 in the A frame 20, each control the positioning of a respective slidable lock 120, in traveling from its unlocked to its locked position, with respect to releasing and or to holding in place the respective end 34 of a shaft 36, about which a roll 12 of roofing material 14 is positioned.

I claim:

1. A self contained apparatus used to rotatably hold and movably unroll sheets of roofing material effectively sealably pressing the roofing material directly in place on roofing surfaces of structures, by sealably securing these sheets to the roofing surfaces and to the overlapped edges of adjacent sheets of like roofing material by preheating the roofing material about to leave the roll and using the combined pressing weight of the roll of roofing paper and the pressing cantilevered weight of the self contained apparatus, comprising:

(a) A frame to support all the components of this self contained apparatus and in turn be supported at three spaced triangular locations all of which are to be adjacent to a roofing surface, having:

(i) spaced receivers of this frame at two of these three spaced locations to receive ends of a shaft about which a roll of roofing material is positioned, and when the roll is so positioned, this frame is thereby essentially supported in a cantilevered position on the roofing surface at these two spaced locations;

(ii) a wheel subassembly of this frame at the remaining spaced location, which in its triangular location is located opposite the midlength of a shaft on which a roll of roofing material is to be withdrawn, in a direction away from the wheel subassembly; and (b) a heating subassembly mounted on this frame having pivotal supports, in turn having spaced heating units, which are thereby adjustably positioned to be placed at a specified distance from the ever changing diameter of a roll of roofing material being heated and sealably positioned on a roofing surface, having heating fluid distribution lines distributing heating fluid to the spaced heating units, as the heating fluid is released through a control valve of this heating subassembly, with these heating fluid distribution lines conducting heating fluid to be derived from a tank of heating fluid positioned on a holder of this heating subassembly, having an actuator of this heat subassembly used in adjustably positioning the spaced heating units, having a control valve and having a holder to receive a tank of heating fluid; and (c) a shaft to first receive a roll of roofing material and thereafter to be placed on a roof and then to be guided by the spaced receivers of the frame.

2. A self contained apparatus, as claimed in claim 1, wherein the spaced receivers of the frame have vertical slots open at the bottoms, whereby these spaced receivers via their slots are lowered over the shaft on which the roll of roofing material has been positioned, whereby the weight of the roll of roofing material is directly on the roofing surface.

3. A self contained apparatus, as claimed in claim 2, wherein the spaced receivers of the frame have multiple pairs of vertical slots open at their bottoms, wherby only one when the spaced receivers, via their slots, are lowered over the shaft on which the roll of roofing material has been positioned, thereby selectably adjusting the distance between the exterior of the roll of roofing paper and the spaced heating units.

4. A self contained apparatus used to rotatably hold and movably unroll sheets of single ply modified bitumen roofing material directly in place on roofing surfaces of stuctures, while sealably securing these sheets to the roofing surfaces and to the overlapped edges of adjacent sheets of like roofing material under thepressure created by the cantilevered weight of the self contained apparatus, by immediately following preheating, of both the roofing surface, and the roofing material about to leave the roll, as well as the already laid edge of roofing material, comprising:

(a) an inclined A frame carriage having an apex top and spaced bottom sides, having a handle extending in both horizontal transverse directions from the apex top of the inclined A frame, having receiving open bottom slot structures located respectively at the spaced bottom sides of the inclined A frame, to receive ends of a roofing material roll shaft, having a near top cross frame member, in turn having a depending heating fluid tank support structure, in turn having a depending wheel support structure, having a near bottom cross frame member, in turn having depending pivotal structure to receive a heating subassembly of spaced burner torches and their heating fluid supply lines, and having a bottom cross frame member joining the receiving open bottom slot structures;

(b) a hand operated actuator extended between the handle of the inclined A frame and the depending pivotal structure, which is selectively operated by the operator of this self contained apparatus to pivot the pivotal structure and thereby to move a heating subassembly, so the distance between burner torches and an outer layer of rolled roofing material is kept at the same dimension that is selected on a particular day in reference to overall outside temperatures;

(c) a heating fluid control and heating fluid distribution subassembly, extended between the handle of the inclined A frame and a heating subassembly, and ready to be extended to a heating fluid tank;

(d) a heating subassembly secured to the depending pivotal structure having spaced burner torches directed toward the receiving open bottom slot structures, where a roofing material roll shaft is to be positioned, and having heating fluid supply lines to receive heating fluid from the heating fluid control and heating fluid distribution subassembly, and to distribute the heating fluid throughout the heating subassembly, whereby the spaced burner torches are supplied with heating fluid.

5. A self contained apparatus used to rotatably hold and movably unroll a sheet of single ply bitumen roofing material, as claimed in claim 4, wherein the receiving open bottom slot structures have multiple sets of slot structures, only one set being used at one time, to receive ends of a roofing material roll shaft at selective spaced distances from the heating subassembly, depending on the present diameter of a roll of roofing material, thereby adding to the capability of maintaining the specified distance between the burner torches and the roll of roofing material as selected in reference to the outside temperature on a particular working day.

6. A self contained apparatus used to rotatably hold and movably unroll a sheet of single ply bitumen roofing material, as claimed in claim 4, wherein the depending heating fluid tank support has an offset foot kicker bar used by an operator in conjunction with the handle to pivot the inclined A frame carriage to clear the receiving open bottom slot structures from the ends of a roofing material roll shaft, when positioning a new roll of roofing material to be heated, distributed, and sealed in place on a roof surface by using this self contained apparatus.

7. A self contained apparatus used to rotatably hold and movably unroll a sheet of single ply bitumen roofing material, as claimed in claim 4, wherein the receiving open bottom slot structures have bottom slidable locks to pass across the bottom slot structures, after the shaft ends are in place, to thereby keep each shaft end in place, so no roll of roofing material will inadvertently become separated from this self contained apparatus when this roofing material is being sealed in place on an inclined roof.

8. A self contained apparatus used to rotatably hold and movably unroll a sheet of single ply bitumen roofing material, as claimed in claim 4, comprising, in addition, a heat shield secured to and depending from the inclined A frame carriage and spaced forwardly of the depending heating fluid tank support structure, to shield a heating fluid tank from the heat generated, when the spaced burner torches are in operation.

* * * * *